US006413637B2

(12) United States Patent
Cipparrone et al.

(10) Patent No.: US 6,413,637 B2
(45) Date of Patent: Jul. 2, 2002

(54) SHAPE MEMORY CORDS FOR REINFORCING ARTICLES MADE FROM ELASTOMERIC MATERIAL

(75) Inventors: Marco Cipparrone, Fiesole (IT); Gurdev Orjela, Arlon (BE); Guido Riva, Milan (IT)

(73) Assignee: Pirelli Coordinamento Pneumatici S.p.A., Milan (IT)

( * ) Notice: Subject to any disclaimer, the term of this patent is extended or adjusted under 35 U.S.C. 154(b) by 0 days.

(21) Appl. No.: 09/822,352

(22) Filed: Apr. 2, 2001

Related U.S. Application Data

(62) Division of application No. 09/172,034, filed on Oct. 14, 1998, now Pat. No. 6,237,663.
(60) Provisional application No. 60/073,323, filed on Feb. 2, 1998.

(30) Foreign Application Priority Data

Oct. 14, 1997 (EP) ..... 97830519

(51) Int. Cl.[7] ..... B32B 15/06; B32B 15/18
(52) U.S. Cl. ..... 428/379; 428/375; 428/377; 428/378
(58) Field of Search ..... 428/375, 378, 428/379, 377

(56) References Cited

U.S. PATENT DOCUMENTS

| | | | | |
|---|---|---|---|---|
| 4,258,543 A | | 3/1981 | Canevari et al. | |
| 5,242,002 A | | 9/1993 | Oku | |
| 6,237,663 B1 | * | 5/2001 | Cipparrone et al. | 152/527 |
| 6,257,291 B1 | * | 7/2001 | Cipparrone et al. | 152/527 |
| 2001/0012558 A1 | * | 8/2001 | Cipparrone et al. | 428/295.7 |

FOREIGN PATENT DOCUMENTS

| | | | |
|---|---|---|---|
| EP | 0290328 | | 11/1988 |
| EP | 0363893 A2 | | 4/1990 |
| EP | 0909665 A1 | * | 4/1999 |
| JP | 5-125632 | * | 5/1993 |

OTHER PUBLICATIONS

Patent Abstracts of Japan—JP 04,362,401, "Tire" Dec. 15, 1992 (Abstract only).

T.W. Duerig et al., "Engineering Aspects of Shape Memory Alloys," Butterworth–Heinemann, pp. 256–259 (1990).

J. Cederström et al., "Relationship Between Shape Memory Material Properties and Applications," Journal de Physique IV, C2, pp. 335–341 (1995).

* cited by examiner

*Primary Examiner*—Cynthia H. Kelly
*Assistant Examiner*—J. M. Gray
(74) *Attorney, Agent, or Firm*—Finnegan, Henderson, Farabow, Garrett & Dunner, LLP

(57) ABSTRACT

Metal cord for use in reinforcing fabric for articles made from rubber, such as pneumatic tires, conveyor belts, flexible tubes, and similar, comprising a plurality of such metal cords orientated parallel to each other in a single direction and in which each cord comprises metal wires wound spirally around each other, wherein at least one of the wires of the cord consists of a shape memory material. During the phase of incorporation of the cords into the elastomeric material, the shape memory wire tends to recover the shape memorized initially and, by means of the force generated during this recovery, transmits by friction to the surrounding wires forces tending to shorten the pitch of the cord with spacing of each wire from the next, resulting in good penetration of elastomeric material between the wires. The closure of the cord is maintained in the subsequent heat cycles, owing to the memory degradation characteristics imparted to the wire. The invention is particularly suitable for fabrics forming belt layers and casing plies in pneumatic tires.

9 Claims, 3 Drawing Sheets

SHAPE MEMORY CORDS FOR REINFORCING ARTICLES MADE FROM ELASTOMERIC MATERIAL

This application is a divisional of U.S. patent application Ser. No. 09/172,034, filed Oct. 14, 1998, now U.S. Pat. No. 6,237,663B1, in the U.S. Patent and Trademark Office; additionally, Applicants claim the right of priority under 35 U.S.C. §119(a)–(d) based on patent application No. 97830519.1, filed Oct. 14, 1997, in the European Patent Office; further, Applicants claim the benefit under 35 U.S.C. §119(e) based on prior-filed, copending provisional application No. 60/073,323, filed Feb. 2, 1998, in the U.S. Patent and Trademark Office; the contents of all of which are relied upon and incorporated herein by reference.

The present invention relates to articles made from elastomeric material, particularly pneumatic tires, reinforced with rubberized fabrics comprising cords with at least one shape memory wire; and also to the said fabrics and to the corresponding cords.

The invention also relates to a process for the manufacture of these rubberized fabrics.

Many articles made from elastomeric materials, including pneumatic tires for vehicle wheels, conveyor belts, flexible hoses for the transport of fluids and similar, comprise at least one rubberized fabric formed by a plurality of reinforcing cords, normally textile or metal, disposed parallel to each other and incorporated in an elastomeric material.

In the following part of the present description, the wording "elastomeric material" is intended to denote the composition of the incorporating material as a whole, in other words the rubber, including the polymer base, the reinforcing fillers and the various protective, accelerating, anti-ageing and other agents, the whole according to recipes which are well known to those skilled in the art.

It is also known that metal cords are formed from a plurality of single metal wires wound spirally with respect to each other, with predetermined intervals, according to a plurality of configurations which are well known to those skilled in the art.

In general, the cited articles require cords having particular characteristics of mechanical strength when exposed to various stresses, including tensile and compressive stresses, and having corrosion resistance. Corrosion may be initiated in the metal wires of the cord by the presence of moisture in the residual air inside the cords incorporated in the rubber, or by direct contact with water when the breaking of the rubber layer exposes the cord to the external environment.

Once initiated, the corrosion may be propagated along the wires in the absence of a suitable protective coating of the wires.

To meet the requirement of corrosion resistance, it is convenient for the space between the metal wires of the cord to be completely filled with rubber to avoid the presence of air incorporated between the wires and subsequent formation of moisture with consequent development and propagation of the corrosion phenomenon.

DESCRIPTION OF THE RELATED ART

Additionally, in order to resist mechanical stresses, the wires of the cords must be closely associated with each other in order to ensure correct behaviour in operation, as represented graphically, in a Cartesian stress-strain diagram, by a substantially linear characteristic.

In fact, due to the distance between the wires, a cord is subject to mechanical hysteresis and to a risk of failure of the wires; even under a compressive load lower than that withstood by a cord in which the distance between the constituent wires is minimal or zero.

The requirements of good penetration of the rubber between the wires and high performance of the cords in operation are particularly important in pneumatic tires; these are normally made by assembling a plurality of different semi-finished components, some of which consist of strips of various sizes formed from the previously cited rubberized fabrics.

The manufacture of the rubberized fabrics for pneumatic tires is carried out by incorporating the bare cords in an elastomeric material, preferably by means of known rubberizing devices, such as extruders and calenders, supplied from feed reels of the bare cords disposed before the said devices. It is during-this stage of incorporation that the penetration of the elastomeric material into the cords has to be achieved.

There are various known solutions designed to ensure good penetration of the rubber into the cord, all characterized in that the cords which are easily penetrable by the rubber do not have optimal behaviour in the pneumatic tire during its use.

In one solution suitable for stranded cords, the cord comprises a first pair of wires disposed in one plane and a second pair of wires disposed in a further plane which rotates with respect to the first along the longitudinal development of the cord, so that in each cross section the surfaces of the wires have maximum exposure and consequently maximum coating with elastomeric material. This solution entails a non-uniformity in the disposition of the wires along the development of the cord, with unsatisfactory performance in use.

A different solution specifies cords in which the wires are kept slack (open cords) so that a small distance is left between them. In the passage through the rubberizing device, the distance set between the wires permits good penetration of rubber into the cord. This solution may cause the compacting of the wires against each other, owing to the tension to which they are subjected even before they reach the device, thus making it impossible or very difficult for the rubber to penetrate into the cord; when this does not happen, the cord is rubberized in an optimal way but maintains a behaviour which is hysteretic, and therefore unsatisfactory, in use.

A further solution specifies the disposition in the cord of a wire having a non-linear (zigzag) configuration, so that a space is provided between each of the various wires and the next, and the penetration of rubber to the centre of the cord is promoted. This solution entails lower fatigue resistance of the non-linear wire and therefore of the whole cord.

If we now examine cords of the multilayer type, these comprise a central core covered with a plurality of concentric layers of wires, as in the case of the known cord having a 3+9+15 configuration, in other words a core of three wires twisted together, round which is wound a first layer of nine wires on which is wound a second layer of fifteen wires. These cords are used, in particular, in the casing plies of pneumatic tires for trucks.

In this cord, little rubber penetrates into the inner layer, and practically none penetrates into the core, owing to the physical barrier created by the radially outer layers of wires. In these types of cord, in order to achieve sufficient rubber penetration, the solution based on the use of wires of different diameters is convenient.

Although on the one hand this solution improves the rubber penetration, on the other hand it is unsatisfactory in respect of the performance of the cord in use.

To improve the characteristics of the behaviour of the pneumatic tyre in use, metal cords in which at least one of the component wires is made from an alloy of a shape memory material have recently been used.

Shape memory materials are described, for example, in pages 3 to 20 of the publication "Engineering Aspects of shape memory alloys", Butterworth-Heinemann, published in 1990.

Shape memory wire, as will be described in greater detail subsequently, has the properties (1) of possessing a precise memorized shape which is imparted to it by a heat treatment carried out at a specified temperature which imparts to the wire a predetermined critical point, (2) of losing this shape as a result of mechanical stresses imparted at a temperature below the critical point, and (3) of returning to the memorized shape whenever its temperature exceeds the critical point.

For use in pneumatic tires, this type of wire, which has been heat treated so that it has, for example, an undulating shape, is subjected to a stretch which imparts another configuration, for example linear, at ambient temperature, before it is stranded with the other wires to form a cord.

Whenever the temperature in the pneumatic tire increases, for example as a result of high speed, to a point higher than the critical point of the shape memory wire, the wire tends to return to the originally memorized undulating shape.

However, since the shape memory wire is stranded with the other wires and the whole cord is fixed to the elastomeric matrix, and the whole structure is subject to tension, this wire is unable to contract to assume its own undulating configuration of lesser length.

Consequently, there is an increase in tensile stress in the shape memory wire (the wire acts as a stretched spring), the effect of which is to increase the rigidity of the structure in opposition to the effect of centrifugal force.

In particular, U.S. Pat. No. 5,242,002 describes a radial tire whose belt assembly comprises three belts, the first two having cords symmetrically inclined with respect to the equatorial plane and the third having cords disposed circumferentially.

The cords are formed from a plurality of wires wound spirally with respect to each other and each cord of the inner belts comprises a plurality of metal wires, at least one of which is made from an alloy of a shape memory material.

Japanese patent application JP 4362401 relates to a radial tyre having a belt structure whose outer layer comprises a two-way shape memory expansion element, preferably an element of the spring type made from a Ni-Ti alloy, wound in the circumferential direction (at 0°) on the underlying belt layers.

The shape memory element tends to contract in the circumferential direction when the tyre is subjected to heating in high speed travel. However, since this contraction is impeded by the underlying belt structure, the element develops a tensile force which makes the belt assembly more rigid, thus controlling the phenomenon of expansion of the tyre at high speed.

At low speeds or in normal conditions of use, the shape memory element maintains the initial shape or returns to the initial shape as a result of the inflation pressure. The applicant has perceived that the failure to achieve optimal behaviour as described above may depend on the particular behaviour of the said cords with shape memory wires which, together with their advantages, pose a considerable problem.

What happens in practice is that, during the vulcanization of the tyre, which, as is well known, is carried out at a temperature of the order of 150° C. and sometimes above, in its initial stage, when the rubber compound has low viscosity, the contraction of the shape memory wire causes the opening of the cord, in other words the spacing apart of the component wires.

The rubber is then vulcanized, losing its plasticity, but the cord is unable to close up, being prevented from doing so by the contraction of the shape memory wire, and is therefore consolidated in the vulcanized tyre in this swollen configuration, with all the cited disadvantages of unstable behaviour and low compressive strength, resulting particularly in poor resistance to the bending and compression stresses.

The cited patents U.S. Pat. No. 5,242,002 and JP 4362401 fail to deal with this aspect, and therefore the problem of improving the penetration of the elastomeric material between the wires of a cord while obtaining good performance of the cord, and consequently of the tyre in use, remains substantially unresolved at the present time.

SUMMARY OF THE INVENTION

The applicant has realized that it is possible to improve simultaneously the characteristics of penetration of the rubber between the wires of a cord and the performance of the cord in the tyre in use, by making use of cords which contain at least one shape memory wire with characteristics of recovering a previously memorized shape, and are active principally in a first heat cycle, the wire also being provided with programmed significant characteristics of degradation of the memory after the first heat cycle.

The following preliminary observations and definitions relating to shape memory materials will help to provide a clearer understanding of the nature of the applicant's invention.

Shape memory is the capacity, possessed by some metal alloys, of eliminating deformations of an apparently plastic nature by a suitable heating of the material.

It is known ("Shape Memory Alloys"- ed. H. Funakubo - Gordon and Breach Science Publisher - 1987) that the properties of shape memory are imparted by a solid-solid phase transformation (from martensite to austenite when passing from low to high temperature, and vice versa), called "thermoelastic martensitic transformation". This transformation is known as "direct" in the case of cooling and "inverse" in the case of heating. Direct transformation, which corresponds to the formation of the martensitic structure, starts at a temperature $M_s$ and finishes at a lower temperature $M_f$. Inverse transformation, which corresponds to the formation of the austenitic structure, starts at a temperature $A_s$ and ends at a higher temperature $A_f$.

Since, in general, $M_s \neq M_f \neq A_s \neq A_f$, the said martensitic transformation is hysteretic. In particular, if $M_f < M_s < A_s < A_f$, the martensitic transformation is said to be of Type 1; if $M_f < A_s < M_s < A_f$, the martensitic transformation is said to be of Type 2.

The martensite phase has a typical microstructure consisting of dominoes (called martensitic variants) which may be orientated differently under the action of even limited stress states (e.g. 50 MPa). A shape memory material acquires a predetermined shape by a heat treatment for a specific time and at a specific temperature. This treatment is carried out on the wire of a specific material of particular composition in order to obtain a predetermined transformation temperature. When the material is cooled, the transformation from the austenite phase to the martensite phase takes place, and, if the material is subjected to a stress state capable of producing the process of orientation of the variants, the deformation $\epsilon^*$ associated with this phenomenon, becomes permanent, for temperatures of less than $A_s$, after the removal of the force (pseudo-plastic deformation). However, during the subsequent heating to temperatures of more than $A_s$, the deformation $\epsilon^*$ is eliminated by inverse martensitic transformation, and consequently the original shape is recovered (the shape memory effect). The elimination of the deformation $\epsilon^*$ is total if $\epsilon^* \leq \epsilon_{max}$ where $\epsilon_{max}$ is the maximum deformation eliminable by the shape memory effect, and is characteristic of the specific shape memory material and of the specific heat treatment used to impart the memory. If the elimination of $\epsilon^*$ is impeded, partly or entirely, by conditions of mechanical constraint in the passage from the temperature $A_s$ to the higher temperature $A_f$ during heating, the material develops a tensile force called the reconversion force.

In conclusion, the heat treatment is used to impart the four characteristic temperatures of a shape memory alloy, indicated above as $M_s$, $M_f$, $A_s$, $A_f$.

The capacity of complete elimination of the deformation $\epsilon^*$ in the subsequent heat cycles undergone by the material is generally subject to a degradation, represented by the decrease in the number of subsequent heat cycles in which this elimination can be obtained, this degradation increasing as $\epsilon^*$ approaches $\epsilon_{max}$. The decrease in the value of the portion $\epsilon^*$ of the residual eliminable pseudo-plastic deformation, also known as the "shape memory degradation", is defined as a continuous change of the characteristics of the shape memory of a material, determined by the number of heat cycles undergone, and represents the useful life of a shape memory material.

For a more precise definition of the shape memory degradation of a material, reference should be made to the description in pages 256 to 259 of the publication "Engineering Aspects of Shape Memory Alloys", Butterworth-Heinemann, published in 1990. In this publication it is stated that the life of such a material is expressed as the recoverability of a given previously memorized shape. When the material is no longer capable of recovering the memorized shape, its useful life is considered to be ended.

For example, for a NiTi alloy in which $\epsilon_{max}$=8%, the number of subsequent heat cycles for which a deformation $\epsilon^*$ can be repeatedly and completely eliminated varies as a function of the value of $\epsilon^*$, as shown in the following table (from J. Cederstrom and J. VanHumbeeck, J. de Physique IV C2, 1995, pp. 335–341).

| $\epsilon^*$ | Heat cycles |
|---|---|
| 8% (=$\epsilon_{max}$) | 1 |
| 4% | 100 |
| 2% | 10000 |
| 1% | 100000 |

It will be seen from the table that if an elongation $\epsilon^*$ (pseudo-plastic deformation) of 8% is imparted to the material, particularly to the metal wire, it will be completely eliminable during the first heat cycle, but will no longer be eliminable in the subsequent heat cycles, during which only a progressively decreasing fraction of this elongation can be eliminated. Conversely, if the imparted pseudo-plastic elongation $\epsilon^*$ is only equal to 2%, it will be completely eliminable through 10000 subsequent heat cycles before the start of degradation. For the purposes of the present invention, each heat cycle comprises both the heating phase and the subsequent phase of cooling of the material.

If a pseudo-plastic deformation $\epsilon_{tot}$ of more than $\epsilon_{max}$ is imparted to the said material, this deformation consists of an eliminable portion $\epsilon^*$ and a non-eliminable portion $\epsilon_{pl}$ (plastic deformation). Therefore $\epsilon_{tot}=\epsilon^*+\epsilon_{pl}$.

In this case also, in subsequent heat cycles $\epsilon^*$ always coincides with $\epsilon_{max}$, although here the value of $\epsilon_{max}$ changes continuously and in each specific cycle depends on the number of heat cycles undergone previously.

In other words, if the same deformation $\epsilon_{tot}$ is always produced at the end of each heat cycle, the composition of $\epsilon_{tot}$ varies from one cycle to the next, with a progressive decrease in the eliminable portion $\epsilon^*$ and a simultaneous increase in the portion of plastic deformation $\epsilon_{pl}$.

The applicant has realized that considerable advantages in the performances of cords can be obtained by using, for at least one wire, shape memory materials with suitable characteristics of memory degradation produced in the wire by a specific heat treatment carried out on the wire before it is stranded with the other wires.

The applicant has realized that it is possible to make advantageous use of the shape memory effect of the wire, in other words the capacity of eliminating an imposed elongation by the recovery of a predetermined initial shape, by limiting this effect to the phase of incorporation of the cords in an elastomeric material, in order to obtain optimal penetration of the rubber into the cord, making this phase simultaneous with the first heat cycle to which the cord, and with it the shape memory wire, is subjected.

Preferably, this phase of incorporation is carried out at a temperature $T_1$ which is greater than the minimum temperature $A_s$ of the transformation range $[A_s–A_f]$ assigned to the wire and, even more preferably, also greater than the maximum temperature $A_f$ of the said range.

The shape memory wire is previously subjected to an elongation of predetermined value $\epsilon^*$ while it is at a temperature $T_0$ lower than $A_s$ (for example, ambient temperature), and is then stranded together with the other wires, by known methods and means, to form a cord.

In the phase of incorporation of the cord which contains the said shape memory wire, carried out at high temperature, the elimination of the deformation takes place in association with a contraction of the wire which, in a condition of friction with the other wires of the cord, develops a contractile force and therefore causes a disarrangement of the wires, in other words a swelling of the cord.

In practice, the cord is made to open with consequent good penetration of rubber into it.

Subsequently, the tension exerted on the cords after the incorporation phase, during the picking up of the fabric and its cooling from the incorporation temperature to values progressively decreasing to the ambient temperature, advantageously causes the recovery of the deformation state of the shape memory wire with a return to the value of $\epsilon^*$, possibly by means of the limited forces required by the processes of orientation of the martensite, with a consequent return of the wires towards each other in the cord, until their compacting, in other words the closing of the cord, is obtained.

This compact configuration is maintained practically unchanged in the subsequent heat cycles owing to the characteristics of degradation of the shape memory imparted to the shape memory wires which make it impossible to recover a substantial portion of $\epsilon^*$.

In this way the maintenance of a substantially closed configuration of the cords in the subsequent vulcanization heat cycle is obtained, despite the high temperature of the cycle, so that the cord becomes incorporated in the vulcanized tyre in a substantially closed configuration.

Consequently, articles, and in particular pneumatic tires, constructed with rubberized fabrics prepared as stated above show optimal performance of the cords.

In a first aspect, the invention therefore relates to a metal cord for reinforcing articles made from elastomeric material, comprising a plurality of metal wires wound spirally around each other, at least one of which is formed from a shape memory material, is able to recover a previously memorized shape and is deformed away from the said memorized shape, the said cord being characterized in that the said shape memory wire has the said recovery capacities substantially active in a first heat cycle and degraded to at least a significant predetermined extent after the said first heat cycle.

In another aspect, the invention relates to a metal cord for reinforcing articles made from elastomeric material, such as pneumatic tires, conveyor belts, flexible hoses and similar, comprising a plurality of metal wires wound spirally around each other, at least one of the said wires being formed by a shape memory material, the said cord being characterized in that the said shape memory wire, at ambient temperature, has:

- the memory of a different shape, with a length $l_0$ which is less than the length $l_1$ of the wire at ambient temperature, memorized at a temperature $A_s$ which is greater than the ambient temperature $T_0$;
- a pseudo-plastic elongation $\epsilon_{max/c}$ eliminable by the shape memory effect, and having a value of between 0.2% and 8% of the length of the said memorized shape;
- an elongation $\epsilon_{tot}$ having a value of at least 85% of the said value $\epsilon_{max/c}$;
- a decrease in the residual eliminable pseudo-plastic elongation $\epsilon^*$, after a first heat cycle carried out at a temperature $T_1>A_s$, this decrease being at least 40% of the value of the said pseudo-plastic elongation $\epsilon_{max/c}$.

In a second aspect, the invention relates to a rubberized fabric for use in articles made from elastomeric material reinforced with the cords according to the invention, as defined above: alternatively, the invention relates to a rubberized fabric for use in articles made from elastomeric material comprising a plurality of reinforcing cords incorporated in the elastomeric material of the said fabric and disposed so that they are coplanar with, parallel to and adjacent to each other in the same direction, each cord being formed by a plurality of metal wires wound together spirally, at least one of the constituent wires of at least one of the said cords being formed from a shape memory material, the said fabric being characterized in that the said wire made from shape memory material has the following characteristics at ambient temperature:

- the memory of a different shape, with a length $l_0$ which is less than the length $l_1$ of the wire at ambient temperature, memorized at a temperature $A_s$ which is greater than the ambient temperature $T_0$;
- a pseudo-plastic elongation $\epsilon_{max/t}$ eliminable by the shape memory effect, and having a value of between 0.1% and 8% of the length $l_0$ of the said memorized shape;
- a pseudo-plastic elongation $\epsilon_{tot}$ having a value of at least twice the said value $\epsilon_{max/t}$;
- a decrease in the residual eliminable pseudo-plastic elongation $\epsilon^*_{N+1}$ for each subsequent heat cycle, carried out at a temperature $T_1>A_s$, this decrease being at least 40% of the value of the pseudo-plastic elongation $\epsilon_{max/N}$ of the preceding cycle.

In the fabric according to the invention, the perfect rubberizing of the metal wires of the cords was obtained during the fabric rubberizing heat cycle by the spacing actions exerted on the adjacent metal wires by the shape memory wire which tends to recover the predetermined memorized shape of smaller length, with consequent renewed swelling of the cord and penetration of rubber between the wires of the open cord: conversely, the good performances of the cords of the said fabrics in the tyre in use are obtained by the configuration of the cords which remains substantially closed in the heat cycles developed during the use of the tyre, owing to the decrease in the value of the residual pseudo-plastic elongation $\epsilon^*$ eliminable by the shape memory effect, this decrease occurring as a result of the heat cycles of the rubberizing of the fabric and the vulcanization of the tyre.

In a third aspect, the invention relates to an article made from elastomeric material, and more particularly to a pneumatic tyre for vehicle wheels, reinforced with the cords according to the invention, and more preferably with the rubberized fabrics according to the invention, as described above; in a preferential aspect, the invention relates to a pneumatic tyre for vehicle wheels, comprising a toroidal casing having a crown portion and two axially opposing sides, terminating in a pair of beads for fixing the tyre to a corresponding mounting rim, a tread band disposed on the crown of the said casing and a belt structure interposed between the said casing and the said tread band, the structure of the said tyre comprising a plurality of reinforcing cords, each formed by metal wires wound spirally with respect to each other, at least one of which is a wire made from a shape memory material, characterized in that the said wire made from a shape memory material has the following characteristics are ambient temperature:

- the memory of a different shape, with a length $l_0$ which is less than the length $l_1$ of the wire at ambient temperature, memorized at a temperature $A_s$ which is greater than the ambient temperature $T_0$;
- a pseudo-plastic elongation $\epsilon_{max/p}$ eliminable by the shape memory effect, with a value of between 0.05% and 8% of the length $l_0$ of the said memorized shape;
- a pseudo-plastic elongation $\epsilon_{tot}$ having a value of at least six times the said value $\epsilon_{max/p}$;
- a decrease in the value of the residual eliminable pseudo-plastic elongation $\epsilon^*_{N+1}$ for each heat cycle following that of the vulcanization of the tyre, carried out at a temperature $T_1>A_s$, this decrease being at least 40% of the value of the pseudo-plastic elongation $\epsilon_{max/N}$ of the preceding cycle.

Preferably, the tyre is of the radial type and the rubberized fabrics with cords comprising at least one shape memory wire are used in the belts and/or in the plies of the casing.

In a further aspect, the invention also relates to the process of assembly of the said pneumatic tire, characterized by the use of the cords as described above.

In yet another different aspect, the invention relates to a process for the manufacture of a rubberized reinforcing fabric for articles made from elastomeric material, such as pneumatic tires conveyor belts, flexible tubes and similar, comprising a plurality of reinforcing cords oriented parallel to each other in a single direction and incorporated in the elastomeric material of the said fabric.

In these fabrics, each cord comprises metal wires wound spirally around each other and, in at least one of the said cords, at least one of the component wires is formed from a shape memory material which has memorized, by means of a suitable heat treatment, a predetermined shape with a length less than that of the wire at ambient temperature and which is deformed by elongation at ambient temperature by a predetermined percentage amount $\epsilon_{tot}$.

The process, comprising the known phases of incorporating the cords in a layer of elastomeric material to form the said reinforcing fabric, and then cooling and picking up the fabric, is based on the innovative phases of:

a) using a shape memory wire with characteristics of degradation of the shape memory effect such that the pseudo-plastic elongation $\epsilon_{max}$ eliminable by the shape memory effect, after the heat cycle of the rubberizing of the fabric, lies between a value of zero and a value equal to a maximum of 40% of the initial value $\epsilon_{max}$, with a decrease in $\epsilon_{max}$ in each subsequent heat cycle preferably having the same percentage value as that in the preceding cycle;

b) incorporating the cords in the elastomeric material at a temperature $T_1$ greater than the temperature of the start of the transformation phase $A_s$;

c) in the phase of incorporation of the cords in the elastomeric material, using the recovery of the predetermined shape memorized by the wire to transmit to the surrounding wires the reconversion force originating during the said recovery, with effects of spacing the said wires away from each other and penetration of the rubber into the cord in a substantially open configuration;

d) pulling the cords during the cooling and pick-up of the fabric to restore the original length of the said cords.

BRIEF DESCRIPTION OF THE DRAWING

In any case the present invention will now be more clearly understood with the aid of the following description and of the attached figures, provided solely by way of example and not for the purpose of restriction, in which.

DETAILED DESCRIPTION OF PREFERRED EMBODIMENTS

Figure 1:
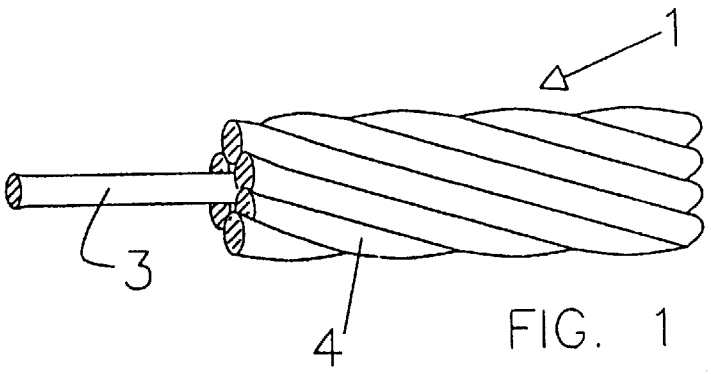
FIG. 1 is a perspective enlargement of a metal cord according to the invention.

The invention is described initially with reference to a metal cord 1 (FIG. 1) designed to form a reinforcing element for an article made from elastomeric material.

For simplicity of representation, the illustration shows a cord of the type comprising a rectilinear wire 3 in a central position, forming the core of the cord, surrounded by a layer of six wires 4 wound spirally around the said central wire, forming the shell. However, it is specified that the cord may have any known configuration, either of the stranded type or of the type with a central core and one or more concentric layers, in which both the core and the layer or layers may be formed from single wires or from stranded wires or from any combination of these.

Examples of known cords, particularly those used for reinforcing pneumatic tires for vehicle wheels, are those usually identified as 1×4, 3×7, 1+6, 2+2, 1×3+6+15.

In the cords according to the invention, at least one wire, for example the wire 3 of the 1+6 cited above, is made from a shape memory material with the characteristics specified below, while the other wires (4) are of the conventional type made from steel, preferably of the HT type, in other words steel with a high carbon content, namely >0.9%.

In pneumatic tyre technology, the diameter of the said wires is preferably between 0.12 mm and 0.38 mm.

The shape memory material of the wire 3 is preferably made from alloys selected from the group comprising Fe-Mn-Si, Cu-Zn-Al, Cu-Al-Ni, Cu-Al-Be, Fe-Ni-Co-Ti, and Ni-Ti alloys.

Before being stranded with the other wires to form the bare cord, the wire 3 has undergone a heat treatment which has imparted to it a predetermined memorized shape, a specified range of transformation temperatures ($M_s$ $M_f$ $A_s$ $A_f$) and a particular gradient of decrease in the shape memory for subsequent heat cycles.

After the said heat treatment, it has also undergone stretching, at a temperature $T<A_s$, which has imparted to it a pseudo-plastic deformation $\epsilon_{tot}$ and a length $l_1$.

Consequently, in the cord according to the invention the shape memory wire, at the ambient temperature $T_0$ which is conventionally assumed to be 25° C., has the following characteristics:

the memory of a different shape, with a length $l_0$ which is less than the length $l_1$ of the wire at ambient temperature, memorized in the temperature range $A_s$–$A_f$, where $A_s$ is greater than the ambient temperature $T_0$;

a pseudo-plastic elongation $\epsilon_{max/c}$ eliminable by the shape memory effect, with a value of between 0.2% and 8% of the length $l_o$ of the said memorized shape;

an elongation $\epsilon_{tot}$, imparted by stretching the wire at ambient temperature, having a value of at least 85% of the said value $\epsilon_{max/c}$;

a decrease in the residual eliminable pseudo-plastic elongation $\epsilon^*$, after a first heat cycle carried out at a temperature $T_1>A_s$, this decrease being at least 40% of the value of the said pseudo-plastic elongation $\epsilon_{max/c}$.

Preferably the said elongation $\epsilon_{tot}$ has a value of not less than the said value $\epsilon_{max/c}$.

In particular, for the previously cited materials, the value of the elongation $\epsilon_{max/c}$ as defined above varies with the material, being, for example, 0.2% for a Fe-Si-Mn alloy and 8% for a Ni-Ti alloy.

The maximum reconversion force exerted by the said alloys is 400 MPa (megapascals) for a Fe-Si-Mn alloy and 600 MPa for a Ni-Ti alloy.

Preferably, the decrease, after a first heat cycle carried out at a temperature $T_1>A_s$, of the residual eliminable pseudo-plastic elongation $\epsilon^*$ (also referred to in the present description as the degradation of the shape memory material) is also maintained in the subsequent heat cycles which the cord undergoes during the assembly and use of the product.

More precisely, if $\epsilon^*$ indicates the quantity of deformation eliminable by the memory effect in the first heat cycle, the degradation of the wire can be defined as the value of the quantity of residual eliminable deformation at the end of the subsequent heat cycle.

According to the invention, this value is not more than 40% of $\epsilon^*$ and preferably not greater than 35% of $\epsilon^*$.

Preferably, the pseudo-plastic elongations $\epsilon^*_N$ eliminable in the heat cycles following the first are determined by the following law:

$$\epsilon^*_N = Q\% \epsilon^*_{N-1}$$

where N is the progressive number of a heat cycle following the first and Q% is the percentage of deformation eliminable by the shape memory effect which the material can make available in the subsequent heat cycle as a result of the degradation phenomenon.

Preferably the value Q% is selected to be not more than 40% of $\epsilon^*_N$, preferably not greater than 35% and still more preferably not greater than 25% of $\epsilon^*_N$.

According to the characteristics specified above, the shape memory wire, in the cord according to the invention, develops its maximum contraction during the first heat cycle to which it is subjected, normally that of the rubberizing of the fabric, at the end of which its contraction capacity is substantially reduced or practically zero. In a preferred embodiment, the reconversion force exerted by the shape memory wire during the first heat cycle is between 50 MPa and 800 MPa.

To sum up, the cord is capable of opening during the fabric rubberizing phase, when a high possibility of penetration of the rubber into the cord is required, while it remains substantially compact during the vulcanization of the tyre.

Degradation of shape memory has always been seen as a negative element in the said materials, and consequently its use according to the invention constitutes a novelty in the art, given that these materials are generally used precisely because of their capacity of recovering the shape stored in memory in a manner which is practically constant in time.

It is pointed out that the effect of spacing of the wires which is useful for the opening of the cord can be advantageously enhanced by using a wire 3 treated by a suitable heat treatment in such a way that it memorizes shapes which are more useful than the linear shape for the specified purposes, such as an undulating shape, preferably in the form of a spiral, like a spring.

In this case also, the wire 3 is previously stretched into the linear shape at a temperature $T<A_s$, and then stranded with the other wires to produce the desired cords.

In the fabric rubberizing phase, the wire 3 recovers the undulating shape and transmits spacing forces towards the surrounding wires by the previously mentioned contractile force and by the forces developed by the undulations; in this way a greater opening of the cord and consequently a better incorporation of rubber into it are obtained.

In a particular embodiment of the invention, use was made of a shape memory wire made from Fe-Mn-Si alloy, characterized by an eliminable pseudo-plastic deformation $\epsilon_{max}=2\%$, capable of developing a reconversion force of 400 MPa, with a percentage of eliminable deformation (coefficient of degradation Q%) equal to 25%.

Figure 2:
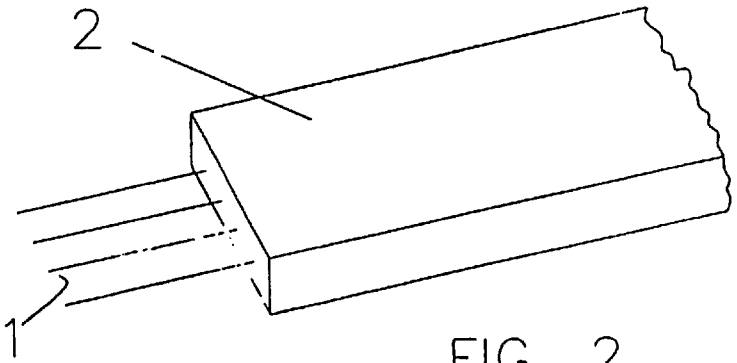
FIG. 2 is a schematic partial perspective view of a rubberized fabric incorporating a plurality of cords according to the invention.

The invention also relates to the rubberized fabric (FIG. 2) provided with the said cords.

A rubberized fabric essentially consists of a strip 2 of elastomeric material whose length is indefinite (or in other words is far greater than the width), comprising a plurality of cords 1 disposed so that they are adjacent to and coplanar with each other, orientated in the longitudinal direction of the strip and incorporated in the elastomeric material.

Portions of rubberized fabric, cut conveniently at suitable angles, form the basic semi-finished products for the assembly of various articles made from elastomeric material, such as pneumatic tires, conveyor belts, flexible hoses for transporting fluids, transmission belts and other similar articles; the said portions of fabric enable the reinforcing elements consisting of the cords to be disposed in the structure of the said articles in the desired position, in the desired way and with the desired orientation.

Figure 3:
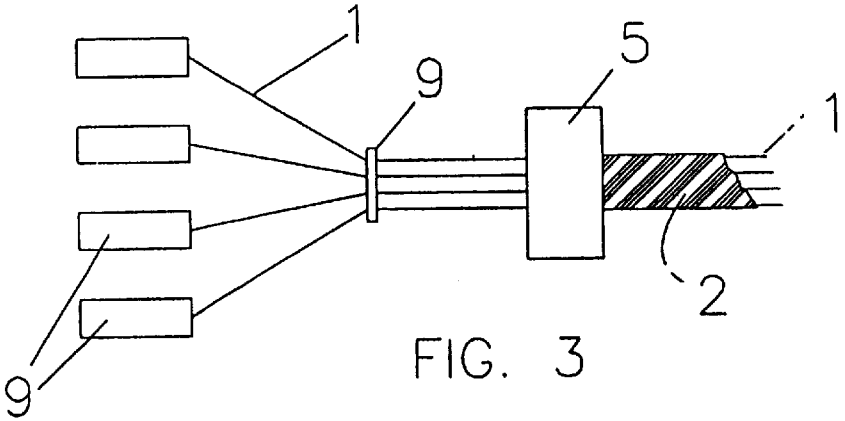
FIG. 3 shows in a diagram provided by way of example a top view of a fabric rubberizing device for incorporating the cords in elastomeric material.

A process for assembly of the fabric consists essentially in the phase of incorporation of the cords in the sheet of elastomeric material by means of a rubberizing device, as shown schematically in FIG. 3, which conveniently consists of a calender with a plurality of cylinders or an extrusion head supplied from an extruder. A plurality of cords 1 is taken to the rubberizing device 5; the rubberized fabric 2 emerges from the calender or from the extruder die and consists of the said sheet of elastomeric material (FIG. 3) incorporating the said plurality of cords 1, orientated in the direction of advance of the sheet, which is picked up under tension, in the form of a continuous strip, by means of a suitable pick-up which is not illustrated since it is of any known type. For ease of understanding and simplicity of description, the following text will only refer to fabric rubberizing carried out by means of a calender.

Figure 4:
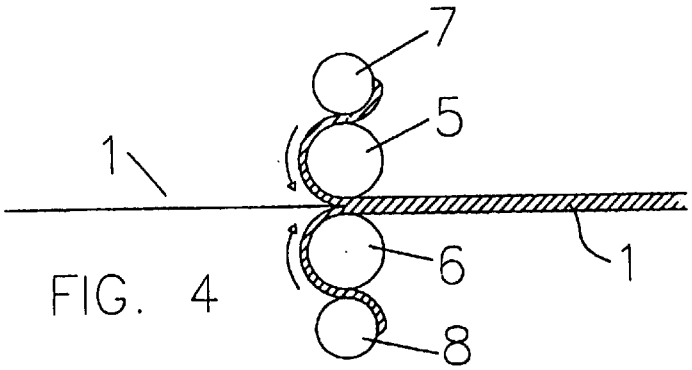
FIG. 4 shows in a diagram provided by way of example a side view of the fabric rubberizing device consisting of a calender.

The said calender comprises, as shown in FIG. 4, two opposing cylinders 5 and 6, rotating in opposite directions to each other, disposed at a distance from each other equal to the thickness required for the fabric: for example, for use in pneumatic tires, this distance is preferably from 0.6 to 4 mm.

Outside the two cylinders 5 and 6 there are disposed at least two other cylinders 7 and 8 designed to process, heat and guide the elastomeric rubberizing material towards the space between the two rolling cylinders 5 and 6, with directions of rotation and flow of the material matching each other, as shown in FIG. 4.

A plurality of reels 9, each comprising a cord wound in a coil over a length of several thousand meters, is disposed ahead of the calender.

The various reels are provided with suitable braking means to regulate the unwinding pull on the cords provided by the cited pick-up device located after the calender: it will be evident that the rubberizing position (the gap between the cylinders 5 and 6) forms a braking point for the advance of the cords, so that different pulls can be applied to the cords ahead of and after the calender, preferably with the greater pull applied after.

A distributor 9' is disposed between the plurality of reels and the rubberizing device to dispose the cords so that they are parallel to and coplanar with each other in a single horizontal plane before they reach the calender.

According to the invention, each reel is loaded with a cord comprising at least one shape memory wire provided with the characteristics cited previously: in particular, it has stored a linear shape of length $l_0$ in a temperature range $A_s$–$A_f$ from 60 to 120° C., and more preferably from 90 to 100° C., where $A_s$ is lower than the calender temperature, in other words the cord rubberizing temperature.

The cords, unwound with a predetermined pull from the corresponding reels, pass through the distributor and from there are taken between the calender cylinders where they reach the calender temperature, preferably between 70° C. and 100° C., and are incorporated between the two sheets of elastomeric material which are supplied from the upper and lower cylinder respectively.

The temperature of the wire 3 of each cord reaching the calender changes from the ambient temperature $T_0$ to the temperature $A_s$ typical of the selected shape memory material, corresponding to the start of a transformation of the wire structure from martensitic to austenitic, with the completion of the said transformation at a temperature below the maximum temperature of incorporation of the cords which is of the order of 100° C.

During the transformation, as stated previously and as is known in the art of shape memory materials, contractile forces arise and are used for the recovery of the shape previously memorized by the wire 3. The recovery force corresponding to the incorporation temperature, which is maximum if $A_f$<the said temperature, is transmitted by friction to the surrounding wires, causing a disarrangement of their reciprocal disposition, preferably with a shortening of the pitch of the cord, and an elimination of the pseudo-plastic deformation $\epsilon^*$ eliminable by the shape memory effect.

In practice, the cord, owing to the recovery of the length "$l_0$" stored initially by the wire 3, and owing to the fact that the elastomeric material in the plastic state permits this, is swollen, with consequent good penetration of the rubber between the wires of which it consists.

On leaving the calender, the newly formed fabric is taken to the pick-up device, by the pull applied to the fabric and therefore to the cords, and is simultaneously cooled from the rubberizing temperature to temperatures decreasing progressively to the ambient temperature $T_0$.

During this cooling, the wire 3 reaches a temperature, typical of the selected shape memory material, at which the transformation from the austenite phase to the martensite phase begins, followed by the complete formation of a martensitic structure a further lower temperature.

During this transformation, in which, as is known, a martensitic structure is deformable even to a considerable extent by limited forces, the pull to which the wire 3 is subjected is sufficient to restore the pseudo-plastic elongation $\epsilon_{tot}$ which the wire itself originally had, with consequent stretching and re-compacting of all the wires of the cord.

In practice, the cord is re-closed, but at the same time the complete rubberizing of each wire is retained.

The advantage of the fabric according to the invention is represented by the fact that the rubberizing heat cycle has practically exhausted the capacity of elimination of the pseudo-plastic elongation $\epsilon^*$, owing to the value of degradation imparted to the cords.

Figure 5:
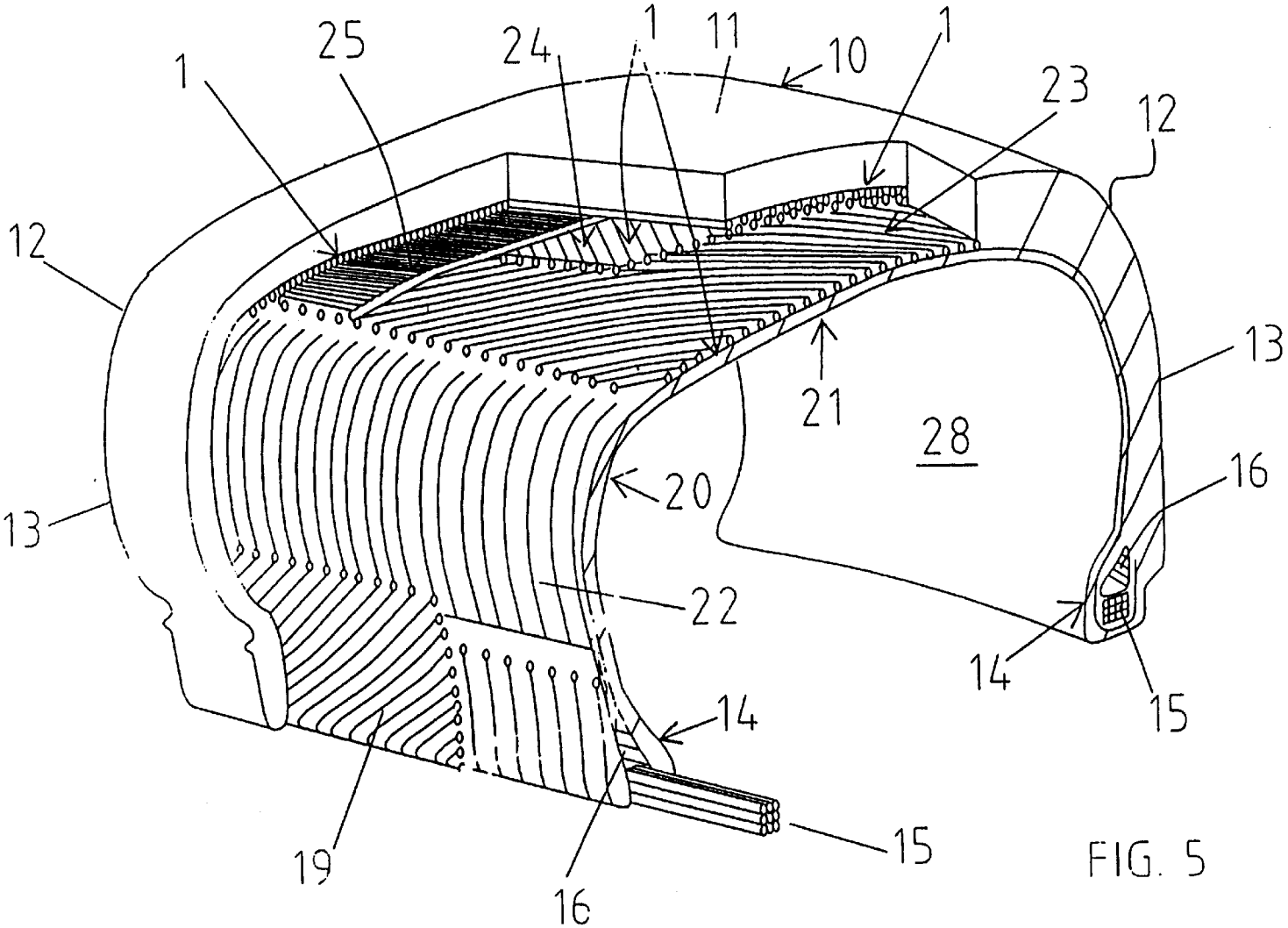
FIG. 5 shows, in a partial perspective view with parts removed, a pneumatic tyre according to the invention.

In accordance with this, preferably, in the rubberized fabric according to the invention, at ambient temperature, the shape memory wire of the cords incorporated in the fabric has the memory of a different shape, with a length $l_0$ which is less than the length $l_1$ of the wire at ambient temperature, stored at a temperature $A_s$ which is greater than the ambient temperature $T_0$, a pseudo-plastic elongation $\epsilon_{max/t}$ eliminable by the shape memory effect and having a value of between 0.1% and 8% of the length $l_0$ of the said memorized shape, a pseudo-plastic elongation $\epsilon_{tot}$ with a value at least equal to twice the said value $\epsilon_{max/t}$ and a decrease in the residual eliminable pseudo-plastic elongation $\epsilon^*_{N+1}$ for each subsequent heat cycle carried out at a temperature $T_1>A_s$, this decrease being at least 40% of the value of the pseudo-plastic elongation $\epsilon_{max/N}$ of the preceding cycle. FIG. 5 illustrates a pneumatic tyre of the radial type 10 made with rubberized fabrics provided with reinforcing cords according to the invention.

The pneumatic tyre 10, to which the invention relates, preferably comprises a radial casing 20, lined internally with a sheet of rubber 28 which is impermeable to air, a tread band 11 disposed on the crown of the said casing, shoulders 12, sidewalls 13, beads 14 reinforced with bead cores 15 and corresponding bead fillers 16, reinforcing tapes 19, and a belt structure 21 interposed between the said casing and the said tread band.

The casing 20 comprises one or more casing plies folded from the inside to the outside around the bead cores 15. The casing ply or plies are formed by portions of rubberized fabric reinforced with cords 22 embedded in the rubber of the fabric, represented schematically.

The belt structure 21 comprises two inner belts 23 and 24, one being radially superimposed on the other, and at least one third belt in a radially outer position.

The belts 23 and 24 are formed by portions of rubberized fabric incorporating metal cords inclined with respect to the equatorial plane of the tyre 10 in such a way that the cords are parallel to each other in each belt and cross each other in the superimposed belts, while the belt 25 is provided with cords orientated circumferentially, in other words at zero degrees with respect to the said equatorial plane.

Similarly, other component elements of the tyre may be formed from portions of rubberized fabric with reinforcing cords suitable inclined with respect to the axial, radial or circumferential directions of the tyre: for example, the cited reinforcing tape 19 has cords inclined at an angle of between 30° and 60° with respect to the radial direction.

All the said reinforcing cords are made from any convenient material, particularly a textile or metallic material, according to the functional characteristics required in the tyre: the invention is concerned preferentially with metallic materials and relates to cords consisting of a plurality of metal wires stranded together, at least one of which is made from a shape memory material according to the invention.

A first example of the use of the wire according to the invention relates to the belt structure of a pneumatic tyre for trucks in which the cords of the crossing belts are metal cords in a 3×0.22+6×0.38 HT LL arrangement, in other words Lang Lay cords (LL=Lang Lay) consisting of a core of three steel wires, with a wire diameter Ø=0.22 mm, surrounded by a layer of six steel wires, with a wire diameter Ø=0.38 mm, where the wires are made from steel with a high carbon content (HT - High Tensile) and have a breaking load of at least 3050 MPa.

The cord comprises at least one shape memory wire made from $Fe_{16}Mn_9Cr_5Si_4Ni$ alloy with a breaking load of at least 750 MPa. The wire has a maximum pseudo-plastic deformation recoverable by the memory effect $\epsilon_{max}$=2% and can exert a maximum reconversion force of 400 MPa. In one case, the shape memory wire is part of the core where the wires are wound with a pitch of 11 mm, while the layer wires are wound with a pitch of 18 mm: both groups of wires are spirally wound with a direction of winding of the "S" type.

In another case, the shape memory wire is part of the layer, the core and layer having the same pitches and directions of winding as those cited above.

Preferably, the shape memory wire, both in this and in other embodiments which will be described, has the same diameter as the steel wire which it replaces.

A further example of an embodiment is provided by a belt structure with fabric strips comprising cords of 3×0.15+6×0.27 HT arrangement with a breaking load of the steel wires equal to 2750 MPa: the winding pitches are 9.5 mm and 12.5 mm, with directions of winding "S" and "Z" respectively. The shape memory wire can replace equally well one or more wires of the core and/or the layer.

Cords according to the invention have also been used as reinforcing elements in the casing plies of pneumatic tires for road transport.

In a first example of an embodiment, the casing cords have a 1×0.22+6×0.20+12×0.20 CC (Compact Cord) arrangement with a breaking load of the steel wires of at least 2750 MPa. The winding pitch is 14 mm, with the direction "S", in both layers.

In a further example of an embodiment, cords with a 1×0.25+6×0.23+12×0.23 CC arrangement were used, again with a breaking load of the steel wires of at least 2750 MPa, with a winding pitch of 16 mm, and a direction "S", in both layers.

The shape memory wire replaced one or more of the steel wires of the core and/or of the six-wire layer and/or of the twelve-wire layer.

These cords have characteristics capable of permitting a complete penetration of the rubber between the wires in the rubberizing phase, while having excellent performance in use; indeed, the analysis of the prototype tires, after vulcanization, has revealed that in all these structures the belt and casing cords showed a complete rubberizing of the wires, even those of the core, confirming their high penetrability by the rubber.

The raw tyre, complete in all parts, is placed in a press for vulcanization where this phase of the process is carried out at a temperature of the order of 140° C., using steam at high temperature and pressure brought to the interior of the tyre by means of a vulcanization chamber which presses the internal toroidal surface of the tyre against the walls of the press: in this phase, the tread band is impressed with a suitable tread pattern.

During the vulcanization phase, the wires 3 of each cord are no longer capable of recovering a pseudo-plastic elongation equal to the elongation $\epsilon^*$ recovered in the first heat cycle, since their capacity to recover the memorized shape has been suitably degraded to a value of residual pseudo-plastic elongation $\epsilon^*_{(1)}$ which is preferably not more than 25% of $\epsilon^*$.

Consequently the force transmitted by friction from the wires 3 to the surrounding wires is much lower than that developed previously: moreover, the wires 3 are capable of opening the corresponding cord to a very small extent only, thus permitting a further penetration of compound into the cord as a result of the high initial fluidity of the compound due to the high temperature in the first stage of the vulcanization process. Preferably the value of the degradation of the residual pseudo-plastic elongation $\epsilon^*_{(1)}$ is suitably selected to maximize this result.

The closing of the cords of the casing plies and of the belts with cords orientated circumferentially is then ensured by the pressure of the vulcanization fluid which swells the tyre, exerting a thrust against the inner surface of the press and putting the casing and belt assembly under tension: preferably, this swelling thrust is further maintained during the gradual cooling of the tyre, with known means and methods of post-swelling.

In use, the tyre undergoes various heat cycles which, as a result of the conditions of use (load and inflation pressure) and/or the driving behaviour and/or the effects of the ambient temperature, cause the heating of the tyre and of the constituent materials, including the cords, to a temperature value which is higher than the previously cited threshold value $A_s$.

However, in these conditions, owing to the degradation of the memory recovery capacity already undergone, and also to the fact that it is embedded in a vulcanized compound, the cord remains practically closed and, moreover, the shape memory wires 3 of each cord can develop a small reconversion force which is rapidly and progressively eliminated: it may be considered that the degradation of the memory recovery capacity imparted to the wires 3 of each cord is such that the said recovery capacity is practically zero after a number of 30–50 heat cycles from the start of the use of the tyre, which is generally characterized by approximately 30–50 thousand heat cycles during its life.

The tires according to the invention are therefore provided with cords comprising at least one shape memory wire, whose behaviour, in the use of the tyre, after a number of initial heat cycles, becomes similar to that of the surrounding wires made from conventional material.

Figure 6:
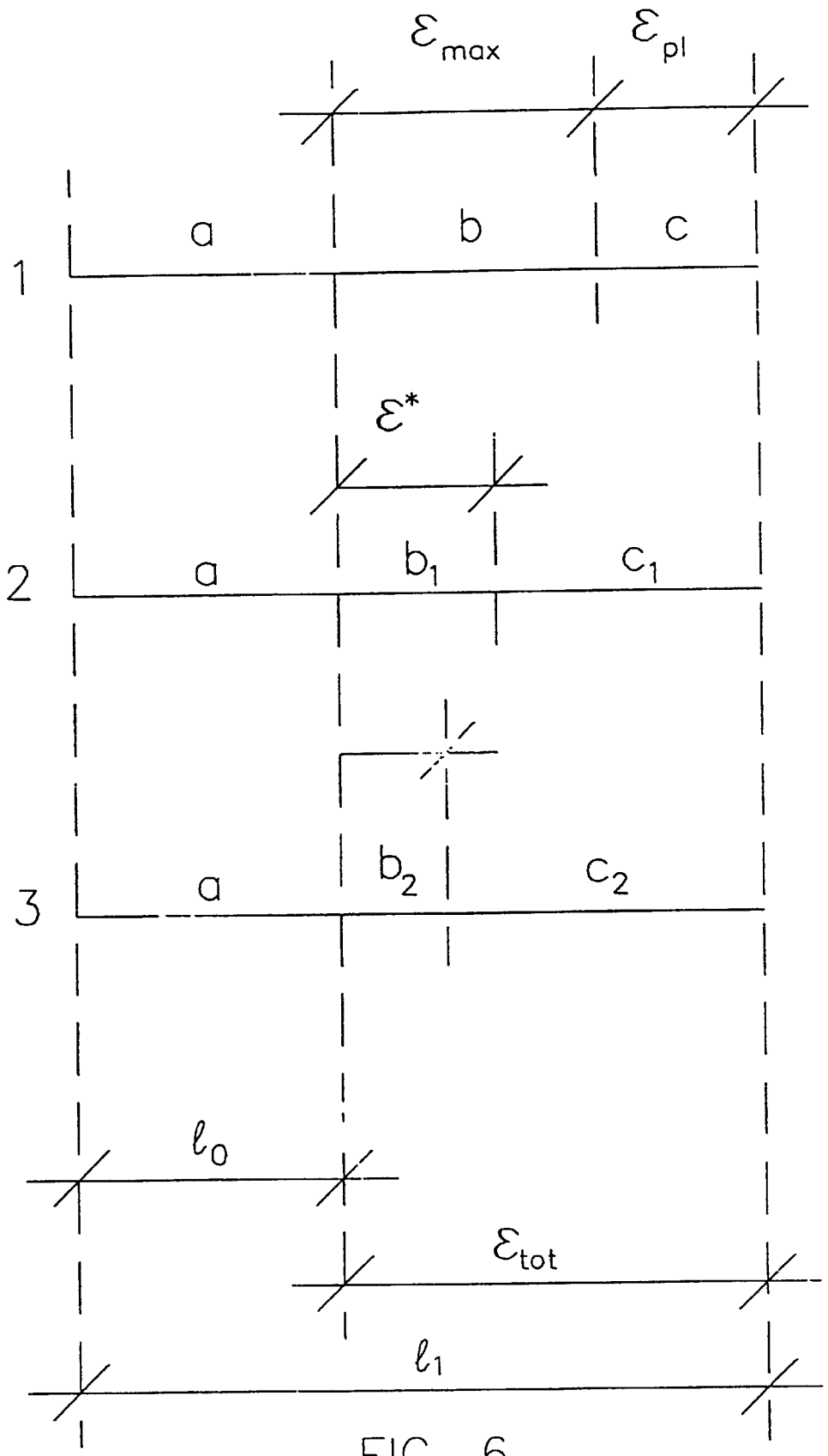
FIG. 6 shows, in a qualitative diagram, the variation of the characteristics of the portion of pseudo-plastic elongation eliminable by the shape memory effect in the corresponding metal wire, for the bare cord, for the cord in the rubberized fabric before vulcanization, and in the vulcanized tyre respectively.

The qualitative diagram in FIG. 6 shows the variation of the characteristics of the portion of pseudo-plastic elongation $\epsilon^*$ eliminable by the shape memory effect, in the corresponding metal wire, for (1) the bare cord, (2) the cord in the rubberized fabric before vulcanization, and (3) in the vulcanized tyre respectively.

The length of a portion of wire made from shape memory material is indicated by $l_1$, and consists of a portion "a" with a length $l_0$ corresponding to the length of the shape memorized in the wire, and a pseudo-plastic deformation $\epsilon_{tot}$ (imparted by elongation of the martensitic structure) which in turn consists of a portion "b" corresponding to the proportion $\epsilon^*$ eliminable by the shape memory effect and a portion "c" corresponding to the proportion $\epsilon_{PL}$ plastically deformed in an irrecoverable way, the symbol $\epsilon$ in this case indicating absolute values rather than percentages of elongation.

The characteristics of degradation imparted to the wire memory according to the invention determine the movement of the separating line between $\epsilon^*$ and $\epsilon_{PL}$ due to the heat cycles undergone by the wire.

In the cord itself, the wire has undergone an elongation $\epsilon_{tot}$ of at least 85% of $\epsilon_{max/c}$ but preferably at least equal to, and more preferably greater than, $\epsilon_{max/c}$, to impose the condition that the degradation of the memory starts with the second subsequent heat cycle: in other words, in the second heat cycle the recoverable proportion of elongation is made to be considerably smaller than the proportion recovered during the first heat cycle. In this way, in each subsequent heat cycle the recoverable proportion of elongation $\epsilon^*$ always coincides with the value $\epsilon_{max/N}$ relative to this cycle and consequently not capable of repetition in the following cycle.

The diagram in FIG. 6, in accordance with a preferred value of degradation of the order of 50%, according to the invention, shows that the value of the recoverable proportion of elongation $\epsilon^*$ is approximately half that of the bare cord in the rubberized fabric and approximately a quarter of the said value in the vulcanized tyre.

The characteristics of the invention described previously in relation to the opening of the cords in the phase of incorporation in the elastomeric material make it possible to use cord arrangements each of which consists of a plurality of layers of metal wires, without the risk of poor penetration of rubber into the wires of the inner layers.

Moreover, owing to the complete penetration of rubber between the wires of the cord it is possible to use any new arrangements of metal cords with a greater number of layers of metal wires than those used in the current art, in particular for the reinforcing cords of the rubberized casing fabrics for motor vehicle tires.

The further characteristic of the closing of the cord in the phase of cooling of the fabric, after calendering, by a pull on the cords regulated in such a way that the wires of each cord are made to approach the centre, favourably permits the recovery of the grouping of the wires substantially as they were before they were moved away from each other in the calendering phase.

This is because, in the cited cooling phase, the shape memory wire subject to the pull regains its initial length, so that all the wires of each cord are re-compacted together according to the pull applied to them, on top of the rubber which has penetrated into the cord, to restore the original length.

The following vulcanization heat cycle is only capable of reopening the cord to a very small extent, while the subsequent heat cycles, up to a rather small number, occurring during the use of the tire can only develop reconversion forces which become weaker as the number of cycles increases.

As has been seen, then, the basic characteristic of the invention, namely a recovery of shape memory which is greatly degraded according to values predetermined at the outset, enables the cord to be kept closed when in use.

If, for example, it is assumed that the pseudo-plastic deformation $\epsilon^*$ recoverable by the memory effect in the first heat cycle is 2% and use is made of a shape memory wire with degradation of the memory effect such that if Q% is 25% there will be a recoverable deformation $\epsilon^*_{(N)}$ in the following N heat cycles (N=1,2,3) of 0.5%, 0.125%, 0.03% respectively, and so on.

Bearing in mind the cited values, it will be evident that the recovery of shape memory can already be considered negligible in the heat cycle immediately following that of the vulcanization of the tire, and can be considered as zero in the thousands of subsequent heat cycles to which a tire may be subjected when in use.

Consequently, owing to the good penetration of rubber between the wires and to the closing of the cord with re-compacting of the wires into the initial configuration, the cord has both good corrosion resistance and high-grade performance when the cord is in use.

The maintenance of the closure of each cord throughout the thousands of heat cycles to which a tire is subjected is manifested, in practice, in the fact that the shape memory wire or wires contained in the cord behave in the same way as the other steel wires of conventional type present in the same cord.

This is because the wire which was originally introduced into the cord precisely because of its capacity of recovering a certain shape loses the shape recovery capacity subsequently, so that, when exposed to the thermal and mechanical stresses to which the cord is subjected, it will behave in the same way as the other wires, particularly in respect of its modulus of elasticity in tension and its elongation at break.

The behaviour of the shape memory wire of the cord according to the invention is therefore entirely different from that described and used in the known art, in which the capacity of recovering the memorized shape is always present and substantially unchanged through a large part of the tire's life.

It is also pointed out that the penetration of the rubber between the wires of a cord can be increased with considerable advantage by increasing the number of shape memory wires.

For example, in a cord structure with a plurality of layers, it is possible to dispose three shape memory wires with an angular interval of 120° between them or four wires with an angular interval of 90° between them or other convenient dispositions to obtain a maximum effect of disarrangement between the wires in the phase of incorporation of the cords into the elastomeric material.

It is also possible to increase the opening of a cord by requiring the manufacturer of the wire to provide, by means of heat treatment, a greater force of recovery of the memory in the fabric rubberizing phase.

In this case, both the choice of the materials and the heat treatment make it possible to obtain temperature values of the start of the austenitic phase and of the end of the austenitic phase corresponding to a recovery force having the desired value.

Therefore, the shape memorized by the linear and/or undulating wire, the material of which it consists, the type of heat treatment, and the number of shape memory wires introduced into the cord advantageously provide different solutions which can be combined with each other in various ways to obtain a desired opening of the cord with consequent high penetration of rubber into it.

A further advantage of the invention lies in the fact that new materials are used in the cord without changing the conventional-pneumatic tire manufacturing cycle.

It is also emphasized that the present solution of the technical problem which had arisen, relating to the use of the degradation of shape memory, is not an obvious or simple choice.

Indeed, it is only in the perception of the applicant that the degradation of shape memory, which has never been used in the prior art and certainly has not been suggested in the publications relating to this subject, since it constitutes a worsening of the behaviour of the shape memory materials, has become a basic characteristic for the solution of a previously unresolved technical problem.

What is claimed is:

1. A metal cord for reinforcing articles made from elastomeric material, comprising a plurality of metal wires wound spirally around each other, at least one of which is formed from a shape memory material, has capacities of recovering a previously memorized shape, and is deformed from the memorized shape, wherein a shape memory wire of the cord has the recovery capacities substantially active in a first heat cycle and degraded to at least a significant predetermined extent after the first heat cycle.

2. The metal cord of claim 1, wherein the shape memory wire at ambient temperature has:

a memory of a different shape, with a length $l_0$ which is less than a length $l_1$ of the wire at ambient temperature, memorized at a temperature $A_s$ which is greater than an ambient temperature $T_0$;

a pseudo-plastic elongation $\epsilon_{max/c}$ eliminable by a shape memory effect, and having a value between 0.2% and 8% of the length $\mathbf{l}_0$ of the memorized shape;

a pseudo-plastic elongation $\epsilon_{tot}$ having a value of at least 85% of the value $\epsilon_{max/c}$; and a decrease in a residual eliminable pseudo-plastic elongation $\epsilon^*$ after a first heat cycle carried out at a temperature $T_1>A_s$, this decrease being at least 40% of the value of the pseudo-plastic elongation $\epsilon_{max/c}$.

3. The metal cord of claim 1, wherein the metal shape memory wire has memorized a linear shape.

4. The metal cord of claim 1, wherein the metal shape memory wire has memorized an undulating shape.

5. The metal cord of claim 1, wherein the metal shape memory wire, in a phase of recovery of the memorized shape, during the first heat cycle, exerts a reconversion force between 50 MPa and 800 MPa.

6. The metal cord of claim 1, wherein the metal cord comprises multiple layers with a central core and the metal shape memory wire is part of the core.

7. The metal cord of claim 1, wherein the metal cord comprises multiple layers with a central core and the metal shape memory wire is part of one of the layers.

8. The metal cord of claim 1, wherein the metal cord comprises multiple strands and the metal shape memory wire comprises one of the strands.

9. The metal cord of claim 1, wherein the shape memory material comprises an alloy chosen from the group consisting of Ni-Ti, Ni-Ti-Co-Fe, Fe-Si-Mn, Cu-Zn-Al, Cu-Al-Ni, and Cu-Al-Be.

* * * * *

UNITED STATES PATENT AND TRADEMARK OFFICE

CERTIFICATE OF CORRECTION

PATENT NO. : 6,413,637 B2 
DATED : July 2, 2002
INVENTOR(S) : Cipparrone et al.

It is certified that error appears in the above-identified patent and that said Letters Patent is hereby corrected as shown below:

Column 18,
Line 50, "$\mathbf{1}_0$" should read -- $l_0$ --.

Signed and Sealed this

Nineteenth Day of November, 2002

*Attest:*

*Attesting Officer*

JAMES E. ROGAN
*Director of the United States Patent and Trademark Office*